US005445323A

United States Patent [19]

Perr et al.

[11] Patent Number: 5,445,323

[45] Date of Patent: Aug. 29, 1995

[54] HIGH PRESSURE FUEL INJECTOR INCLUDING A TRAPPED VOLUME SPILL PORT

[75] Inventors: Julius P. Perr; Arpad Pataki; Thomas L. Szarvas, all of Columbus, Ind.

[73] Assignee: Cummins Engine Company, Inc., Columbus, Ind.

[21] Appl. No.: 339,222

[22] Filed: Nov. 7, 1994

Related U.S. Application Data

[63] Continuation of Ser. No. 110,252, Aug. 23, 1993, abandoned.

[51] Int. Cl.[6] ..... F02M 55/00

[52] U.S. Cl. ..... 239/91; 239/124

[58] Field of Search ..... 239/88–92, 239/124, 125, 533.2, 533.3, 533.15

[56] References Cited

U.S. PATENT DOCUMENTS

| | | | |
|---|---|---|---|
| 2,496,804 | 2/1950 | Meitzler | 239/91 |
| 3,351,288 | 11/1967 | Perr | 239/90 X |
| 3,544,008 | 12/1970 | Reiners et al. | 239/90 |
| 3,831,846 | 8/1974 | Perr et al. | 239/89 |
| 4,396,151 | 8/1983 | Kato et al. | 239/90 X |
| 4,618,095 | 10/1986 | Spoolstra | 239/90 |
| 5,011,079 | 4/1991 | Perr | 239/95 |
| 5,029,568 | 6/1991 | Perr | 123/447 |
| 5,037,031 | 8/1991 | Campbell et al. | 239/535.3 |
| 5,040,727 | 8/1991 | Muntean et al. | 239/91 |
| 5,042,721 | 8/1991 | Muntean et al. | 239/533.3 |
| 5,072,709 | 12/1991 | Long et al. | 123/446 |
| 5,076,236 | 12/1991 | Yu et al. | 123/467 |

FOREIGN PATENT DOCUMENTS

| | | | |
|---|---|---|---|
| 985567 | 7/1951 | France | 239/89 |
| 698144 | 10/1953 | United Kingdom | 239/89 |

*Primary Examiner*—Andres Kashnikow
*Assistant Examiner*—Lesley D. Morris
*Attorney, Agent, or Firm*—Sixbey, Friedman, Leedom & Ferguson

[57] ABSTRACT

An open nozzle unit fuel injector having an injector body for receiving a plunger assembly therein is disclosed including a fuel supply source for providing a metered quantity of fuel to a metering chamber formed in a central bore of the injector body to be injected into the cylinder of the internal combustion engine and a trapped volume spill port for a volume of fuel trapped in the metering chamber when the plunger has moved from its fully retracted position to its fully advanced position and injection has terminated. In accordance with the present invention, an open nozzle unit fuel injector is achieved which exhibits a sharp ending of injection, which prevents secondary injection and which significantly reduces the unburned hydrocarbon emissions of the engine incorporating such open nozzle unit fuel injectors including a trapped volume spill port.

16 Claims, 4 Drawing Sheets

HIGH PRESSURE FUEL INJECTOR INCLUDING A TRAPPED VOLUME SPILL PORT

This application is a Continuation of Ser. No. 08/110,252, filed Aug. 23, 1993, now abandoned.

TECHNICAL FIELD

The present invention relates to unit fuel injectors and in particular to unit fuel injectors of the "open nozzle" type wherein fuel is metered into a metering chamber and is injected through an injection orifice at the tip of the injector body by a reciprocating plunger. More particularly, the present invention is related to a trapped spill port being provided in the reciprocating plunger for spilling the trapped volume within the metering chamber to drain at the commencement of an injection cycle.

BACKGROUND OF THE INVENTION

Heretofore, various types of fuel injectors and fuel injection systems have been known in the prior art which are applicable to internal combustion engines. Of the many types of fuel injection systems, the present invention is directed to unit fuel injectors, wherein a unit fuel injector associated with each cylinder of an internal combustion engine and each unit injector includes its own drive train to inject fuel into each cylinder on a cycled basis. Normally, the drive train of each unit injectors is driven from a rotary camshaft operatively driven by the engine crankshaft for synchronously controlling each unit injector independently and in accordance with the engine firing order.

Of the known unit injectors, there are two basic types of unit injectors which are characterized according to how the fuel is metered and injected. The first type, which is that type to which the present invention is directed, is known as "an open nozzle" fuel injector, in that the fuel is metered through a metering chamber within the unit injector where the metering chamber is open to the engine cylinder by way of an injection orifice during fuel metering. In contrast to the open nozzle type injector, there are also unit injectors classified as "closed nozzle" injectors wherein fuel is metered to a metering chamber within the unit injector while the metering chamber is closed to the cylinder of an internal combustion engine by a needle tip valve mechanism that is opened only during injection by increasing the fuel pressure acting thereon.

In either case, the unit injector typically includes a plunger element that strikes the metered quantity of fuel to increase the pressure of the metered fuel and force the metered fuel into the cylinder of the internal combustion engine. In the case of a closed nozzle injector, a tip valve mechanism is provided for closing the injection orifice during metering where the tip valve is biased toward its closed position to ensure that injection will take place only after fuel pressure is increased sufficiently to open the tip valve mechanism. The present invention is directed to the open nozzle type fuel injector and more particularly to a unit injector fuel injection system that relies on pressure and time principles for determining the quantity of fuel metered for each subsequent injection of each injector cycle. Moreover, the pressure-time principles allow the metered quantity to be varied for each cycled operation of the injector as determined by the pressure of the fuel supply to the metering chamber and the time duration that such metering takes place. Examples of such injectors of the open nozzle type are described in detail in U.S. Pat. No. 4,280,659 issued to Gaal and U.S. Pat. No. 4,601,086 issued to Gerlach, each of which are assigned to the assignee of the subject invention. Each of the injectors disclosed therein include a plunger assembly with a lower portion having a major diameter section that is slidable within an axial bore of the injector body and a smaller minor diameter section that extends within a cup of the injector body. The cup provides an extension of the axial bore which is smaller in diameter than the diameter of the axial bore that passes through the remainder of the injector body. During the metering stage, fuel is metered through a supply port into the axial bore at a point above the cup and the fuel flows around the minor diameter section of the plunger assembly at a tip thereof, thus metering a specific quantity of fuel into the metering chamber of the cup. A radial gap is provided between the minor diameter section of the plunger assembly and the inner wall of the bore within the cup. This gap facilitates the flow of fuel into the injector tip to be injected. Once the metering stage is completed, the plunger travels inwardly (defined as toward the engine cylinder of an internal combustion engine) so as to cause injection of the fuel from the metering chamber through the injector orifice.

The stage just after fuel injection is completed is known as the crush stage, wherein the plunger tip is held tightly against a seat of the cup by an associated drive train of the unit fuel injector. During this crush stage, fuel is trapped within the radial gap between the minor diameter section of the plunger and the inner wall of the bore within a cup. This quantity of fuel is known as the trapped volume. It has been determined that this trapped volume results in the presence of higher levels of unwanted emissions and particularly unburned hydrocarbons in the exhaust gas of an internal combustion engine. The increase in unburned hydrocarbons found in the emissions of the internal combustion engine is due to the tendency of the fuel within the trapped volume to migrate into the engine cylinder after combustion has occurred in the cylinder with such fuel subsequently being exhausted therefrom.

As can be understood from the above, such a problem is unique to open nozzle type fuel injectors, in that closed nozzle fuel injectors rely on a valve mechanism to seal the fuel from the engine cylinder at all times except during injection. Moreover, open nozzle injectors must allow the metering of fuel within the nozzle tip which includes injection orifices that are opened to the engine cylinder.

In an effort to overcome the above mentioned deficiencies, it has been proposed to reduce the trapped volume surrounding the minor diameter section of the plunger within the cup after injection. From the above noted prior art, the only suggestion is to simply reduce the radial gap between the minor diameter section of the plunger in the cup to thus reduce the trapped volume after injection is completed. However, such a modification becomes unacceptable and results in the insurmountable problem of no longer having a sufficient gap for the fuel to be metered into the nozzle area of the cup since the fuel flow around the minor diameter section of the plunger becomes significantly reduced as the gap is reduced. Specifically, it has been found that the quantity of metered fuel to be injected is reduced to a degree that insufficient fuel is injected into the cylinder. Therefore, such a solution is impracticable and unacceptable.

In addition to the foregoing, the components of the injector, specifically the plunger minor diameter section and the inner surface of the bore within the cup become carboned during usage of the unit fuel injector in an internal combustion engine from hot gases within the engine cylinder that are forced back into the injector. Furthermore, as carbon builds up on the minor diameter section of the plunger and the inner wall of the cup, the gap between the minor diameter section of the plunger and the inner wall of the cup continuously decreases over time. Accordingly, the gap must be sized so that even after carboning, a sufficient flow of fuel can be provided through the gap for adequate fuel metering.

It is clear from the above, that the above teachings to reduce trapped volume and to permit fuel metering without effect from injector carboning are in direct conflict with one another. That is, reducing the trapped volume would direct one to decrease the gap between the minor diameter of the plunger and the cup inner wall while reducing the sensitivity to fuel metering after carboning requires the gap size to be increased. The end result of the known open nozzle type unit injector technology is that the above noted goals must be balanced with one another to provide a compromised open nozzle unit type fuel injector that has a gap that partially achieves both goals.

Thus, there is a need for an open nozzle unit fuel injector that can reduce trapped volume between the minor diameter of the plunger and the inner wall of the injector cup while still permitting sufficient fuel flow therebetween to accurately and effectively control the fuel quantity and reduce unburned hydrocarbons in the emissions. Moreover, there is a need to provide such an open nozzle unit fuel injector that will function accurately over the entire useful life of such an injector without adversely effecting fuel metering even after the plunger and cup surfaces become fully carboned.

An effort to achieve such goals is set forth in U.S. Pat. No. 5,042,721 issued to Muntean et al. and assigned to the assignee of the subject invention. Therein, an open nozzle unit fuel injector is disclosed for injecting a metered quantity of fuel into the cylinder of an internal combustion engine. The plunger of the open nozzle unit injector includes a major diameter section which is slidably moveable in an axial bore to open and close a fuel supply orifice and a minor diameter section that extends into the bore of a cup portion of the injector body. The cup portion has an internal surface including plural diameter portions connected by an annular step.

The fuel supply orifice is specifically located within the axial bore and the plunger minor diameter section is designed that such when the plunger is moved from its retracted position to its advance position, a portion of the minor diameter section becomes readily engaged or almost engaged with one of the plural cup surface sections before the major diameter section closes the fuel supply orifice. In doing so, a reduction in the buildup of carbon on the injector surfaces is achieved by reducing the time period during which gas can flow from the engine cylinder into the metering chamber of the unit injector through the injector orifices while maintaining a sufficient flow path for fuel into the metering chamber. However, even with the foregoing improvements, some trapped volume may still be present during the injection cycle.

Similarly, U.S. Pat. No. 5,037,03 1 issued to Campbell et al. and assigned to the assignee of the subject invention discloses an open nozzle fuel injector which includes modifications to either the minor section of the plunger or the cup of the injector housing in order to reduce the volume of fuel trapped during the forward stroke of the plunger assembly. However, as with U.S. Pat. No. 5,042,721, a trapped volume may still be present within the cup of the injector even after carboning of the surface of the plunger assembly and cup.

According, there is a need for an open nozzle unit injector that can reduce the trapped volume between the minor diameter of the plunger and the inner wall of the injector while still permitting fuel flow therebetween to accurately and effectively control the fuel quantity while reducing unburned hydrocarbons in the emissions of the internal combustion engine. Moreover, there is a need to provide such an open nozzle unit fuel injector which will function accurately over the entire useful life of the injector and one which the reduction and trapped volume is uniform across the several injectors of a respective internal combustion engine.

SUMMARY OF THE INVENTION

A primary object of the present invention is to provide an open nozzle unit fuel injector which overcomes the deficiencies described hereinabove with respect to prior open nozzle fuel injectors.

It is a further object of the present invention to reduce the trapped volume in an open nozzle unit fuel injector without adversely effecting the fuel flow to the metering chamber of the injector.

Yet another object of the present invention is to provide an open nozzle unit fuel injector which effectively reduces the trapped volume within the injector in order to significantly reduce unburned hydrocarbons in the engines emissions.

A further object of the present invention is to provide a unit fuel injector which exhibits a sharp end to the injection of fuel into the cylinders of the internal combustion engine.

Yet another object of the present invention is to provide an open nozzle unit fuel injector wherein the trapped volume is reduced within the metering chamber of the injector in order to prevent secondary injection.

Yet another object of the present invention is to provide an open nozzle unit fuel injector which requires a reduce plunger hold down force after injection has occurred in order to maintain the plunger assembly in its fully advanced position as compared to previous open nozzle injectors.

These as well as additional advantages of the subject invention are accomplished by providing an open nozzle unit fuel injector for an internal combustion engine including an injected body having a cup at an end thereof and an axial bore terminating within the cup and at least one injection orifice passing through a tip of the cup through which fuel is injected to a respective cylinder of the internal combustion engine. A plunger assembly is positioned within the axial bore for reciprocating movement in such bore between a retracted position and an advanced position with the plunger assembly including a major diameter section in slidable engagement with the axial bore and a minor diameter section that extends into the cup of the injector body. A mechanism for metering a variable quantity of fuel into the axial bore to be injected through the injection orifice on a cycled basis is provided with the fuel being supplied through a fuel supply orifice opening into the axial bore and a trapped volume spill port for venting a trapped volume of fuel trapped in the axiom bore end cup of the injector body when the plunger assembly moves from the retracted position to the advanced position such that the injector experiences a sharp end of injection while preventing secondary injection and reducing the plunger hold down force required after the injection has taken place. The trapped volume spill port preferably being a fluid passage including a restricted orifice formed in the plunger assembly for communicating the axial bore of the injector body with a drain of the unit fuel injector. Further, it is preferred that the fluid passage extend from the drain of the unit fuel injector to a labyrinth area of the plunger assembly with each restrictive orifice for all injectors of a respective internal combustion engine being of a predetermined and equal diameter.

These as well as further objects, features and advantages of the present invention will become apparent from the following description when read in light of the accompanying drawings which show, for purposes of illustration only a particular embodiment of the present invention.

DETAILED DESCRIPTION OF THE PREFERRED EMBODIMENT

Figure 1:
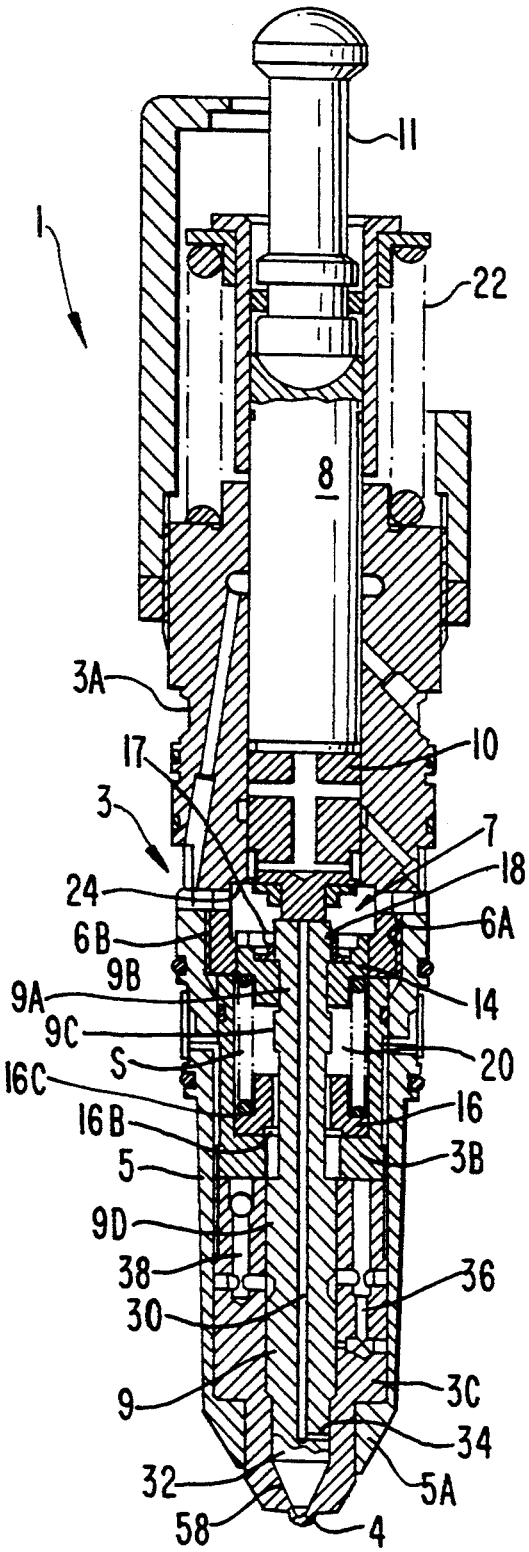
FIG. 1 is a partial cross sectional view of the open nozzle unit fuel injector having a plunger assembly and including a trapped volume spill port in accordance with the present invention shown having the plunger assembly in a fully advanced position.

Initially, it should be noted that while the present invention is described as being used in conjunction with a particular type of open nozzle unit fuel injector, the present invention may be utilized in any open nozzle unit fuel injector where it is desired to reduce the trapped volume within the unit fuel injector. With this in mind, FIG. 1 illustrates an open nozzle unit fuel injector including the present invention which is designated generally by reference numeral 1. The fuel injector is intended to be received within a recess of the head of an internal combustion engine (not shown) in a conventional manner. The injector 1 includes an injector body 3 that has an upper injector barrel part 3A (the section of which is shown on the left having been taken on a plane at a right angle to the section shown on the right in FIGS. 1 and 2), a lower injector barrel part 3B, and injector cup 3C having an injection nozzle including spray orifices for spraying fuel into a respective cylinder (not shown) of an internal combustion engine, and a retainer 5 having a shoulder 5A for capturing the injector body 3. The retainer 5 receives the injector cup 3C, supported on the shoulder 5A with spray nozzle 4 injecting from the bottom end thereof. The lower barrel part 3B is received in the retainer 5 supported on the injector cup 3C. Furthermore, retainer 5 secures the injector cup 3C and lower barrel part 3B together in an end-to-end fashion with the upper barrel part 3A. For this purpose, the top end of the retainer 5 has internal threads 6A by which it is connected to external thread 6B on the bottom of upper injector barrel part 3A, as shown. A central bore extends through the parts 3A through 3C of the injector body of the fuel injector 1 and a reciprocating plunger assembly 7 is disposed in this central bore.

The plunger assembly 7 illustrated in conjunction with this particular open nozzle unit fuel injector includes three distinct plungers. An upper plunger 8 and injection plunger 9 and a timing plunger 10 disposed therebetween. The fuel injector 1 is part of a fuel injector system having a plurality of such injectors, each of which is driven by a rotating camshaft (not shown) by way of a conventional drive train assembly which includes a link 11 that causes the plunger assembly 7 to reciprocate in synchronism therewith. The injection system also includes a fuel pump which may supply all of the fuel injectors with fuel by a column rail system (not shown) which requires three common fluid rails within the cylinder head, one for supplying fuel into the injection chamber, one for draining away fuel that is not injected and a third which supplies timing fluid (which may also be fuel) to vary the timing of the injection by varying the quantity of timing fluids supplied to a variable volume timing chamber defined between the bottom of the upper plunger 8 and the top of the timing plunger 10. These aspects are not novel to the present invention and are described in greater detail in U.S. Pat. No. 4,721,247 which is assigned to the assignee of the subject invention. The '247 patent also describes the need to drain timing fluid at the end of each injection cycle to assure a sharp cutoff of the injection event and whenever the injection pressure exceeds a preset value during the injection stroke to preclude excessive wear and stress on the injector drive train.

Figure 2:
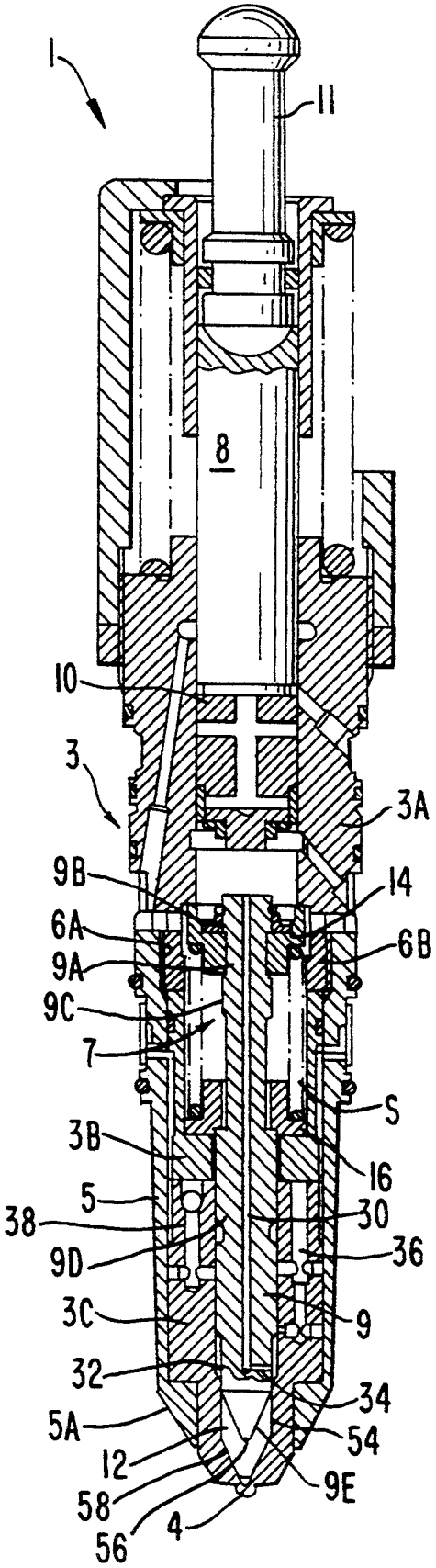
FIG. 2 is a partial cross sectional view of the open nozzle unit fuel injector corresponding to that of FIG. 1 having the plunger assembly shown in the fully retracted position.

With continued reference to FIGS. 1 and 2, at the end of the injection stroke of plunger assembly 7, and after a hold down phase, all of the fuel metered into the injection chamber 12 has been delivered to the combustion chamber of the engine cylinder. In this position, the lower plunger is held seated in the bottom dead center position and in contact with the injection cup 3 against the force of a now-compressed return spring S, by the end to end contact between the plungers 8 through 10 which have been fully driven into the injector body by the action of the link 11 and the drive train associated therewith. The return spring S is captured between an upper spring keeper 14 and a lower spring keeper 16, both of which are of a stepped washer like construction.

The upper spring keeper 14 may be annular and sized to fit axially over the land 9B but not the land 9C in that the lands 9B, 9C and 9D are of successively greater diameters, or these lands may be horseshoe shaped and slid radially onto a reduced diameter portion 9A of the lower plunger 9 that is located between the pair of lands 9B and 9C and retained in place by a retainer ring 17 and spring clip 18. The upper spring keeper 14 also has a flange 14A against which the upper end of the spring S abuts. This flange 14A has a notch 15 which provides a path for draining timing fluid and fuel (which is either released by the timing plunger or leaks upwardly through the clearance between the lower plunger 9 and the lower injector barrel part 3B) to the engine drain flow path. However, in the case of a horseshoe shaped upper spring keeper, this function can be served by the gap between the legs of the horseshoe itself.

The lower spring keeper 16 has a through hole 16A that is large enough to pass over the lands 9B and 9C and has a counterbore 16B (FIG. 1) at its lower end within which a larger intermediate land 9D is able to be received, as shown in FIG. 2. The lower spring keeper 16 also has an annular flange 16C that abuts the bottom of the spring recess 24 formed in lower barrel part 3B of the injector body 3 and carries the bottom end of spring S.

When the plunger assembly is in its innermost or fully advanced position, the spring S is compressed by the force applied to lower plunger 9 by link 11 by way of upper plunger 8 and timing plunger 7. At this point in the injection cycle, the injection of fuel into the cylinder of the engine has been completed and any remaining timing fluid is drained from between the upper plunger 8 and the timing plunger 10. As the link 11 is lifted, a return spring 22 raises the upper plunger 8 and the timing plunger 10 is drawn upwardly with it (or a timing plunger return spring can be provided between the upper spring keeper 14 and the bottom of timing plunger 10). It can be noted that the stop surface 24 is provided for stopping the upward movement of the spring keeper 14 and consequently the upper movement of lower plunger 9. The particular features of the open nozzle fuel injector illustrated in FIGS. 1 and 2 to which the present invention may be readily adapted, is discussed in greater detail in U.S. patent application Ser. No. 945,390 filed Sep. 16, 1992, and assigned to the assignee of the subject invention, the contents of which are hereby incorporated herein by reference.

Figure 3:
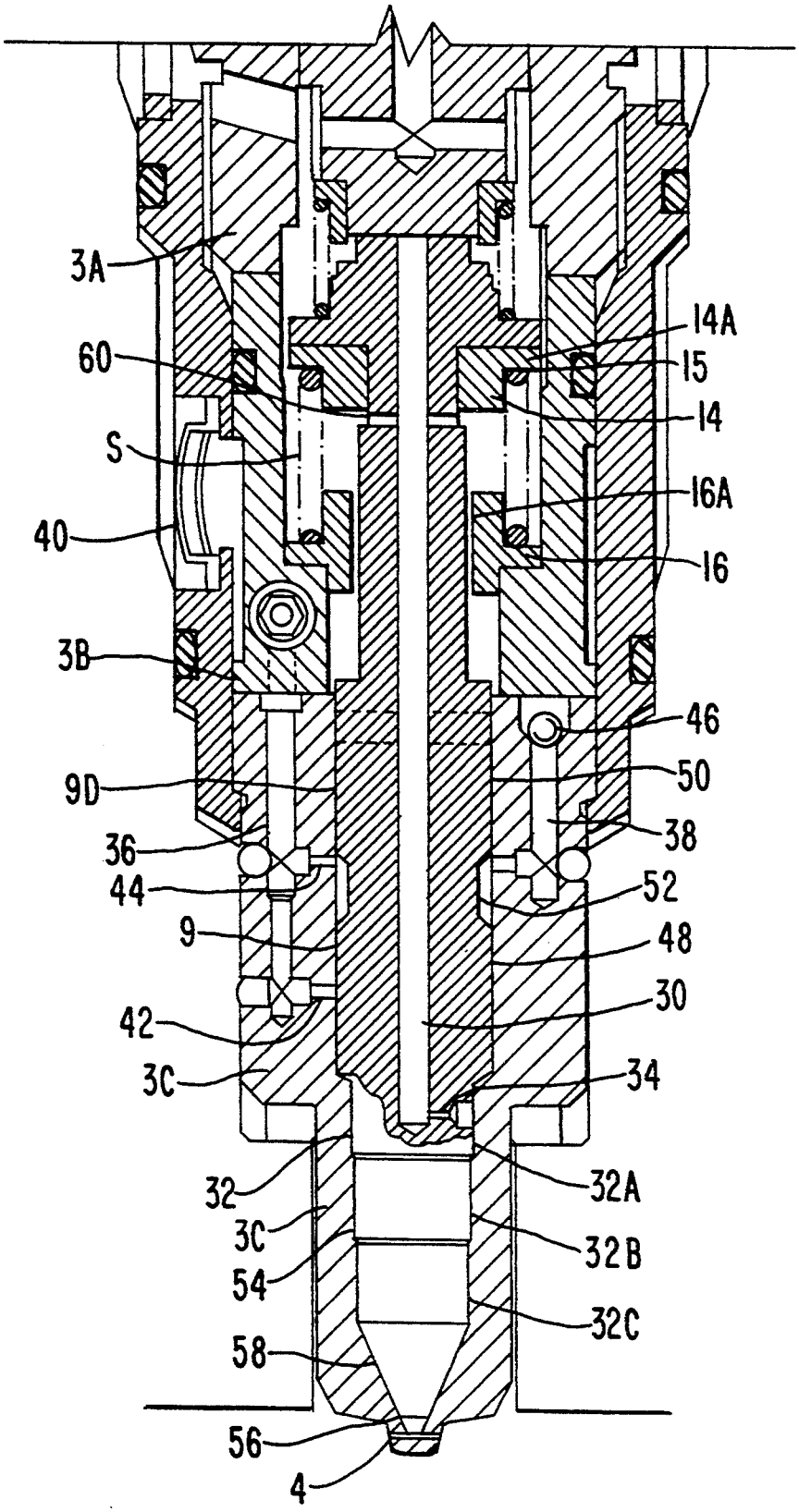
FIG. 3 is an exploded view of the forward most portion of the open nozzle unit fuel injector including the trapped volume spill port formed in the plunger assembly in accordance with a preferred embodiment of the present invention.

As can be seen from FIGS. 1, 2 and 3, formed within the lower plunger 9 is a substantially axially extending central drilling forming central passage 30 which extends from an upper end of the lower plunger 9 to a position within the minor diameter section 32 of the lower plunger 9. Radially extending from the central passage 30 is a small drilling forming an orifice 34 which communicates with the region between the minor diameter section 32 of the lower plunger 9 and the cup portion 3C of the injector housing. The significance of the passage 30 will be explained in greater detail hereinbelow with respect to FIG. 3. Also formed in the cup portion 3C are a fuel supply passage 36 and a fuel drain 38. Again, the operation and significance of the fuel supply passage 36 and drain 38 will be described in greater detail hereinbelow.

Referring now to FIG. 3, the fuel supply passage 36 is provided for passing fuel through the injector body and into the cup 3C for injection into the cylinders of the internal combustion engine. The fuel supply passage 36 may be provided with a check which permits the flow of fuel and only the supply direction, that is such check would prevent back flow of fuel through the supply passage 36. The upper end of the supply passage 36 is connected to a fuel inlet 40 which may include a screen to prevent impurities from entering the injector. It should be understood that the inlet 40 may be associated with a common fuel supply rail (not shown) which is a conventional method of providing fuel to each of the unit injectors of an internal combustion engine. However, other fuel systems may be used for supplying fuel to the several injectors.

The fuel supply passage 36 further includes an inlet orifice 42 that opens into the axial bore with the supply orifice 42 permitting fuel to flow into the metering chamber formed in the cup 3C of the injector body. A second fuel supply orifice 44 also opens into the axial bore at a point above the supply orifice, 42. The second supply orifice supplies fuel for scavenging as will be described in greater detail hereinbelow. The drain passage 38 may also include a check valve 46 for preventing the flow of fuel through the drain passage 38 and into the central bore of the injector.

The lower plunger 9 is divided into first and second major diameter portions 48 and 50 and may include one or more minor diameter sections 32. In the instant case, minor diameter sections 32A, 32B and 32C are illustrated in FIG. 3. The first and second major diameter sections 48 and 50 are separated by a scavenging groove 52 which connects the second supply orifice 44 to the drain passage 38. The-scavenging groove 52 allows fuel flow therethrough when the lower plunger 9 is in advanced position as is illustrated in FIGS. 1 and 3 for cooling and lubricating the lower plunger 9.

The unit injector initiates an injection cycle with the lower plunger 9 in its fully retracted position as is illustrated in FIG. 2. This position is known as the metering stage wherein pressurized fuel is supplied to the supply orifice 42 and into the metering chamber 12 in accordance with pressure and timing principles. In this position, the major diameter section 48 of the lower plunger 9 is located above the supply orifice so as to not impede the flow of fuel into the axial bore and subsequently into the metering chamber 12. It can also be noted from FIG. 2 that a radial gap is formed between the minor diameter section 32 and the inner wall 54 of the cup 3C. This radial gap permits fuel task into the metering chamber 12 of the injector. It should be noted that the minor diameter section 32 of the lower plunger 9 always extends at least partially into the metering chamber 12 and adjacent the inner wall even in the fully retracted position. The region along the minor diameter section 32 and the inner wall 54 of cup 3C is referred to as the labyrinth flow area.

After metering, the lower plunger 9 is driven inwardly with the tapered section 9E of the lower plunger 9 striking the fuel metered into the metering chamber 12 in order to inject the metered quantity of fuel through the orifices 4 and into a cylinder of the internal combustion engine. As may be seen from FIGS. 1 and 3, the lower plunger 9 is in its fully advanced position; illustrating, that position achieved by the lower plunger 9 just after injection is completed, at which time the tip 56 of the lower plunger 9 is seated on seat 58 of the cup 3C.

The radial gap formed between the minor diameter section 32 and the inner wall 54 of the cup 3C is substantially constant along the entire length of the minor diameter section 32. The radial gap forms a volume along the extent of the minor diameter section which traps fuel which has not been injected. This fuel is defined as a trapped volume of fuel. With many known open nozzle injectors, this trapped volume of fuel oftentimes migrates into the engine cylinder after combustion has occurred which significantly increases the presence of unburned hydrocarbons in the vehicle emissions. Accordingly, as discussed hereinabove in the background section and summary of this application, a specific purpose of the present invention is to vent the trapped volume thus reducing such trapped volume which consequently reduces the presence of unburned hydrocarbons in vehicle emissions.

Figure 4:
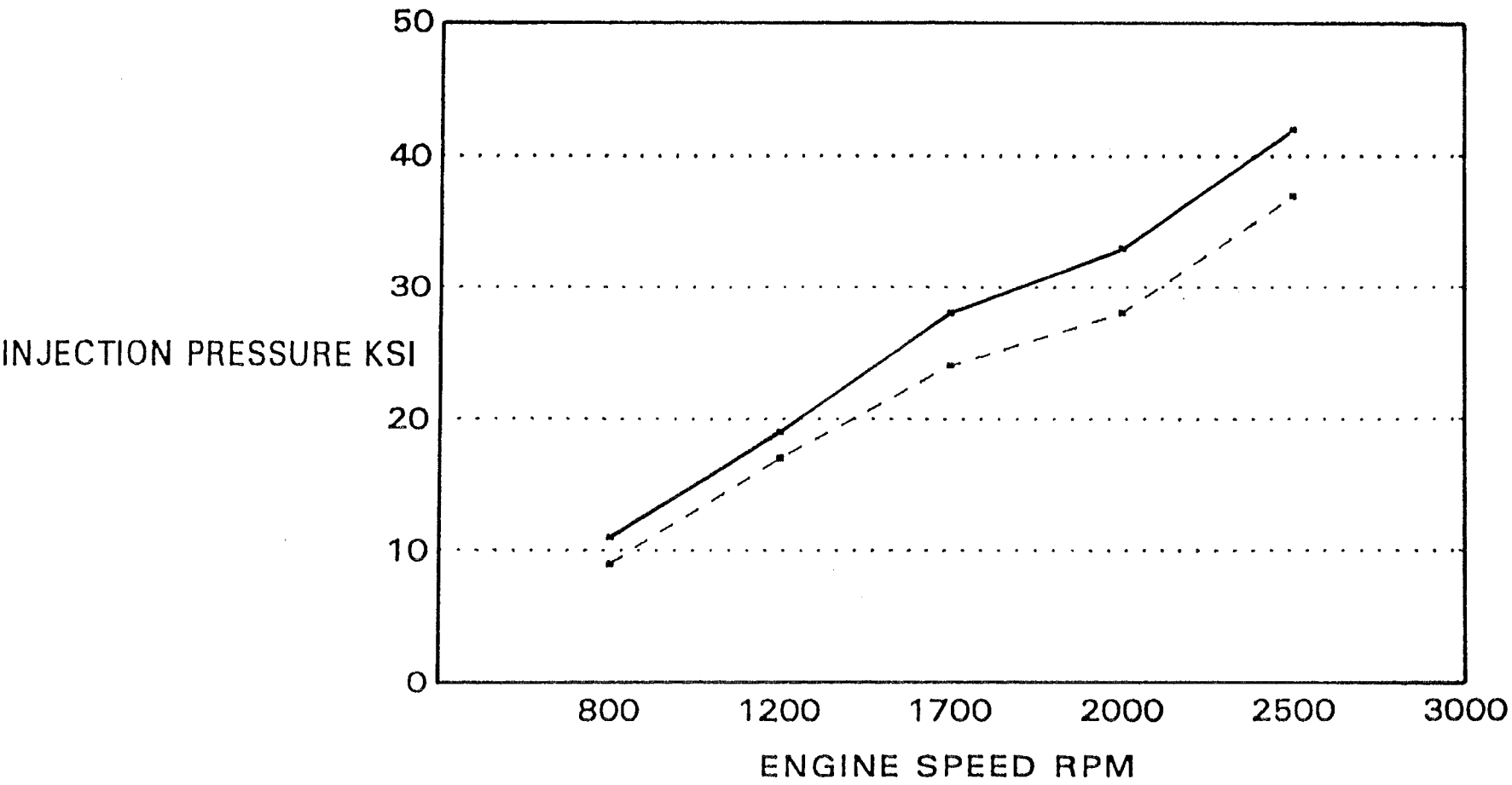
FIG. 4 is a graphic illustration showing the peak injection pressure along the torque curve with and without the trapped volume spill port in accordance with the present invention.
Figure 5:
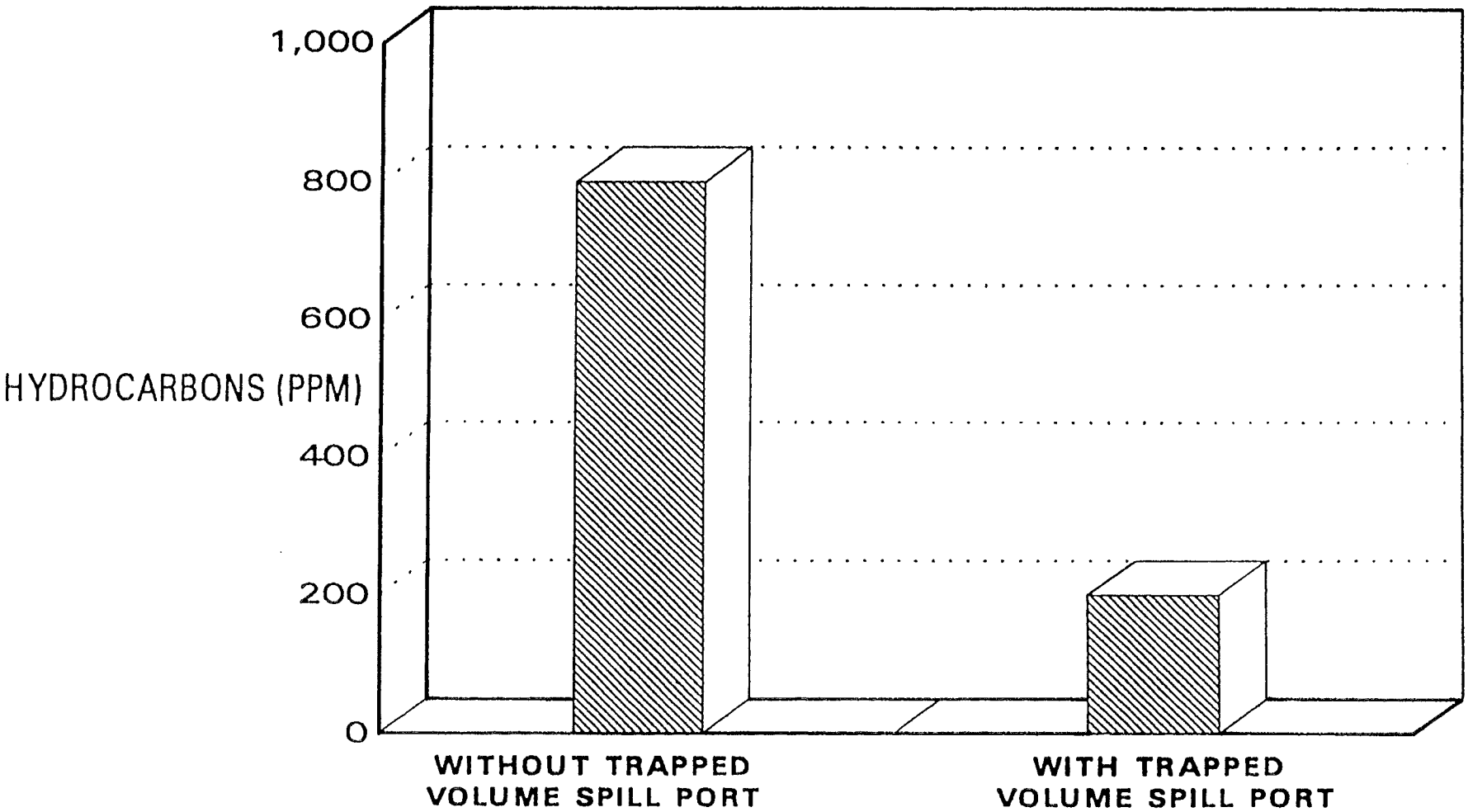
FIG. 5 is a graphic illustration of the reduction in unburned hydrocarbons present in the emissions of an internal combustion engine with and without the trapped volume spill port in accordance with the present invention.

In order to reduce the trapped volume of fuel between the reduced diameter section 32 of the lower plunger 9 and the inner wall 54 of the cup 3C, the axial fluid passage 30 and radial orifice 34 are provided in the lower plunger 9 as discussed hereinabove. A further radial passage 60 is provided in the lower plunger 9 which permits fuel passing through the axial passage 30 to be expelled to the drain of the unit fuel injector. In accordance with a preferred embodiment of the present invention, the axial passage 30 is of a diameter in the range of 1 to 5 millimeters in diameter and preferably in the range of 1 to 2 millimeters in diameter. For the test which have been conducted, the results of which are illustrated in FIGS. 4 and 5, the axial passage 30 is of a diameter of approximately 2 millimeters. The readily extending orifice 34 which extends into the labyrinth area of the plunger which communicates with the trapped volume area is of a diameter of 0.1 to 0.5 millimeters and preferably 0.2 millimeters in diameter. As discussed hereinabove, it is essential that the radial orifice 34 of each injector of a respective engine be within a minimal tolerance of one another such that the vented amount of trapped fuel is consistent from injector to injector within a respective engine. Accordingly, the diameter of the radial orifice 34 is accurately controlled and maintained within a minimal tolerance in order that such consistency may be achieved.

Once in the fully advanced position, the trapped volume which is created between the reduced diameter portion 32 of the lower plunger 9 and the inner wall 54 of the cup 3C is vented through the radial orifice 34 and subsequently the axial passage 30 to the drain of the injector. In doing so, a sharp end of injection is experienced while secondary injection is prevented. Further, because the trapped volume of fuel is vented through the radial orifice 34 and a sharp end of injection is achieved, the trapped volume of fuel does not flow into the engine cylinder after combustion has occurred, thus resulting in a significant reduction in unburned hydrocarbons found in the emissions of an internal combustion engine incorporating the present invention. A further advantage which is achieved in accordance with the present invention is that a reduced plunger hold down force is required after injection in order to maintain the tapered surface 56 in contact with the seat 58 of the injector due to the reduction of the trapped volume and thus the upwardly directed pressure of fuel previously experienced with prior open nozzle injectors.

Referring now to FIG. 4, it can be noted that the peak injection pressure along the torque curve is reduced when the trapped volume spill port is used in accordance with the present invention. The solid line representing an open nozzle unit fuel injector which does not include a trapped volume spill port in accordance with the present invention while the broken line illustrates the identical open nozzle unit fuel injector having the trapped volume spill port incorporated therein. It can also be readily seen from FIG. 5 that a significant reduction in unburned hydrocarbon emissions is achieved in accordance with the present invention. The bar graph illustrated in FIG. 5 clearly shows that an open nozzle unit fuel injector which does not include a trapped volume spill port in accordance with the present invention was found to exhibit hydrocarbon emissions of approximately 800 ppm. In contrast, the identical open nozzle fuel injector incorporating the trapped volume spill port in accordance with the present invention exhibits hydrocarbon emissions of approximately 200 ppm. Clearly, a dramatic reduction in unburned hydrocarbon emissions is achieved in accordance with the present invention. As discussed hereinabove, by venting the trapped volume to drain, the secondary injection that previously existed was virtually eliminated and sharp ending of injection was achieved, thus resulting in the reduction in unburned hydrocarbon emissions. It should be noted that the unburned hydrocarbon emission amounts exhibited in FIG. 5 were measured with the engine operating at approximately 800 rpm and at a load of approximately 25 foot pounds.

Accordingly, by providing an open nozzle unit fuel injector having an injector body for receiving a plunger assembly therein, a fuel supply source for providing a metered quantity of fuel to a cup formed in a central bore of the injector body to be injected into the cylinder of the internal combustion engine and a trapped volume spill port for venting the trapped volume of fuel when the plunger has moved from its fully retracted position to its fully advanced position and injection has terminated results in an open nozzle unit fuel injector which exhibits a sharp ending of injection which prevents secondary injection and which significantly reduces the unburned hydrocarbon emissions of the engine incorporating open nozzle unit fuel injectors including such a trapped volume spill port.

While the present invention has been described with reference to a preferred embodiment, it should be appreciated by those skilled in the art that the invention may be practiced otherwise they has specifically described herein without departing from the spirit and scope of the invention. It is, therefore, to be understood that the spirit and scope of the invention be limited only by the appended claims.

INDUSTRIAL APPLICABILITY

The above described open nozzle unit fuel injector including the trapped volume spill port may be included in a variety of internal combustion engines presently incorporating open nozzle type fuel injectors. Additionally, such an open nozzle unit fuel injector may be utilized in internal combustion engines where it is desired to inject fuel into the cylinders thereof at high injection pressures while achieving a reduction in unburned hydrocarbon emissions.

What is claimed is:

1. An open nozzle unit fuel injector for an internal combustion engine comprising:

an injector body having a cup at an end thereof and an axial bore terminating within said cup and at least one injection orifice passing through a tip of said cup through which fuel is injected;

a plunger assembly disposed within said axial bore for reciprocating movement in said axial bore between a retracted position opening said at least one injection orifice and an advanced position closing said at least one injection orifice, said plunger assembly including a major diameter section in slidable engagement with said axial bore and a minor diameter section that extends into said cup;

a fuel metering means for metering a variable quantity of fuel to said axial bore to be injected through said injection orifice on a cyclic basis, said fuel metering means including a fuel supply orifice opening to said axial bore; and a venting means for venting a trapped volume of fuel trapped in said axial bore and cup to a drain of the unit fuel injector as said injection orifice is closed.

2. The open nozzle unit fuel injector as defined in claim 1, wherein said venting means includes a fluid passage formed in said plunger assembly, said fluid passage communicating between said axial bore and said drain of the unit fuel injector.

3. The open nozzle unit fuel injector as defined in claim 2, wherein said fluid passage includes a restricted orifice of a predetermined diameter communicating with the trapped volume.

4. The open nozzle unit fuel injector as defined in claim 3, wherein said predetermined diameter is the same for all injectors of a respective internal combustion engine.

5. The open nozzle unit fuel injector as defined in claim 4, wherein said predetermined diameter is approximately 0.2 mm.

6. The open nozzle unit fuel injector as defined in claim 3, wherein said fluid passage is positioned substantially coaxially within said plunger assembly and said restricted orifice extends substantially radially from said fluid passage.

7. The open nozzle unit fuel injector as defined in claim 6, wherein said fluid passage extends from the drain of the unit fuel injector to a labyrinth area of the plunger assembly.

8. The open nozzle unit fuel injector as defined in claim 7, wherein said restricted orifice is formed in said labyrinth area of said plunger assembly.

9. An open nozzle unit fuel injector for an internal combustion engine comprising:

An injector body having a cup at an end thereof and an axial bore terminating within said cup and at least one injection orifice passing through a tip of said cup through which fuel is injected;

A plunger assembly disposed within said axial bore for reciprocating movement in said axial bore between a retracted position opening said at least one injection orifice and an advanced position closing said at least one injection orifice, said plunger assembly including a major diameter section in slidable engagement with said axial bore and a minor diameter section that extends into said cup;

A fuel metering means for metering a variable quantity of fuel to said axial bore to be injected through said injection orifice on a cyclic basis, said fuel metering including a fuel supply orifice opening to said axial bore; and A venting means formed in said plunger assembly for venting a trapped volume of fuel trapped in said axial bore and cup to a drain of the unit fuel injector as said injection orifice is closed.

10. The open nozzle unit fuel injector as defined in claim 9, wherein said spill means formed in said plunger assembly is a fluid passage, said fluid passage communicating between said axial bore and drain of the unit fuel injector.

11. The open nozzle unit fuel injector as defined in claim 10, wherein said fluid passage includes a restricted orifice of a predetermined diameter communicating with the trapped volume.

12. The open nozzle unit fuel injector as defined in claim 11, wherein said predetermined diameter is the same for all injectors of a respective internal combustion engine.

13. The open nozzle unit fuel injector as defined in claim 12, wherein said predetermined diameter is approximately 0.2 mm.

14. The open nozzle unit fuel injector as defined in claim 11, wherein said fluid passage is positioned substantially coaxially within said plunger assembly and said restricted orifice extends substantially radially from said fluid passage.

15. The open nozzle unit fuel injector as defined in claim 14, wherein said fluid passage extends from the drain of the unit fuel injector to a labyrinth area of the plunger assembly.

16. The open nozzle unit fuel injector as defined in claim 15, wherein said restricted orifice is formed in said labyrinth area of said plunger assembly.

* * * * *